US007020896B2

(12) United States Patent
Davis

(10) Patent No.: US 7,020,896 B2
(45) Date of Patent: Apr. 4, 2006

(54) CLOTHING INCORPORATED WITH PROTECTIVE DEVICES

(76) Inventor: Ann Davis, 1807 Baybrook Ct., Naperville, IL (US) 60564

( * ) Notice: Subject to any disclaimer, the term of this patent is extended or adjusted under 35 U.S.C. 154(b) by 0 days.

(21) Appl. No.: 10/825,640

(22) Filed: Apr. 15, 2004

(65) Prior Publication Data

US 2005/0229282 A1 Oct. 20, 2005

(51) Int. Cl.
*A41D 11/00* (2006.01)

(52) U.S. Cl. ..... 2/69; 2/80

(58) Field of Classification Search ..... 2/227, 2/79, 80, 300, 69, 75, 111, 112, 24, 16, 23, 2/60–62, 83, 239–242; 602/23, 26, 62
See application file for complete search history.

(56) References Cited

U.S. PATENT DOCUMENTS

| | | | | |
|---|---|---|---|---|
| 4,488,314 | A | 12/1984 | Johnson | |
| 4,608,716 | A * | 9/1986 | Brumfield | 2/2.5 |
| 4,831,661 | A | 5/1989 | Suzuki | |
| 4,845,778 | A | 7/1989 | Peterson | |
| 4,879,765 | A | 11/1989 | Bailie et al. | |
| 5,052,052 | A * | 10/1991 | Gilford et al. | 2/467 |
| 5,105,473 | A * | 4/1992 | Valtakari | 2/461 |
| D335,000 | S | 4/1993 | Johnson | |
| 5,592,689 | A | 1/1997 | Matthews | |
| 5,729,832 | A * | 3/1998 | Grilliot et al. | 2/23 |
| 5,845,335 | A | 12/1998 | Twitty | |
| D417,037 | S | 11/1999 | Bitter | |
| D417,933 | S | 12/1999 | Hanley et al. | |
| 6,014,771 | A | 1/2000 | Kirven | |
| 6,058,505 | A * | 5/2000 | Bettencourt | 2/24 |
| 6,332,224 | B1 | 12/2001 | Walker et al. | |
| 6,343,383 | B1 | 2/2002 | Madorma-Williams | |
| 6,708,342 | B1 * | 3/2004 | Boersema | 2/69 |
| 2003/0000003 | A1 | 1/2003 | Boersema | |

* cited by examiner

*Primary Examiner*—Tejash Patel
(74) *Attorney, Agent, or Firm*—Greer, Burns & Crain, Ltd.

(57) ABSTRACT

The present invention provides an improved article of clothing that protects areas of the body, such as the knee area, elbow area, and the foot area, that are vulnerable to injuries during crawling. In embodiments of the present invention, an article of clothing is incorporated with a knee protective device that includes soft padding for covering the knee area for knee protection, an elbow protective device that includes soft padding covering the elbow area for elbow protection, and a foot protective device that includes soft padding covering the foot area for protection of the foot, and a traction device that includes sufficient coefficient of friction to create stable traction during crawling.

14 Claims, 3 Drawing Sheets

CLOTHING INCORPORATED WITH PROTECTIVE DEVICES

TECHNICAL FIELD

The invention relates generally to an article of clothing incorporated with protective devices and, more particularly, to an article of infant clothing incorporated with protective devices for crawling.

BACKGROUND

There are multiple problems associated with the process of infants learning to crawl. During this learning process, because the motion is generated from contact between infants' hands and knees with the fraction of the floor surface, infants inevitably suffer minor injuries, such as scratches, cuts, or rug burns, while crawling on floor surfaces. Aside from protection, infants need assistance, such as providing additional traction, in the process of crawling.

One prior method provides knee pads to protect the infant from injury during crawling. However, knee pads tend to detach from the infant's body or clothing easily, and they are generally not aesthetically desirable.

Another method provides a pair of socks that is incorporated with the knee pads to address the tendency of the knee pads to be easily detached from the infants during crawling. However, while this method provides some security in securing the knee pads to the infants during crawling, it does not adequately address the problem of the sock rolling down while the infant is crawling.

Still another method provides anti-skid pads that are incorporated into a pair of infant pants. However, this method is restrictive and addresses only the traction issue of the problem. Thus, an improved flexible method to adequately protect the infants from injuries is necessary, while assisting in the process of crawling of the infants.

SUMMARY

In accordance with the foregoing, an article of clothing is provided. According to various embodiments of the invention, the article of clothing is incorporated with a knee protective device that includes soft padding for covering the knee area for knee protection, an elbow protective device that includes soft padding covering the elbow area for elbow protection, a foot protective device that includes soft padding covering the foot area for protection of the foot, and a traction device that includes sufficient coefficient of friction to create stable traction during crawling. As a result, the present invention provides an improved article of clothing that addresses the issue of protection, while providing traction in assisting the process of crawling. Still in another embodiment of the invention, these devices are removable to provide additional flexibility and easy cleaning. Yet another embodiment, the devices are provided in a decorative manner to provide diminished visibility of these devices, creating, at the same time, an aesthetically pleasing garment.

Additional aspects of the invention will be made apparent from the following detailed description of illustrative embodiments that proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION

Figure 1:
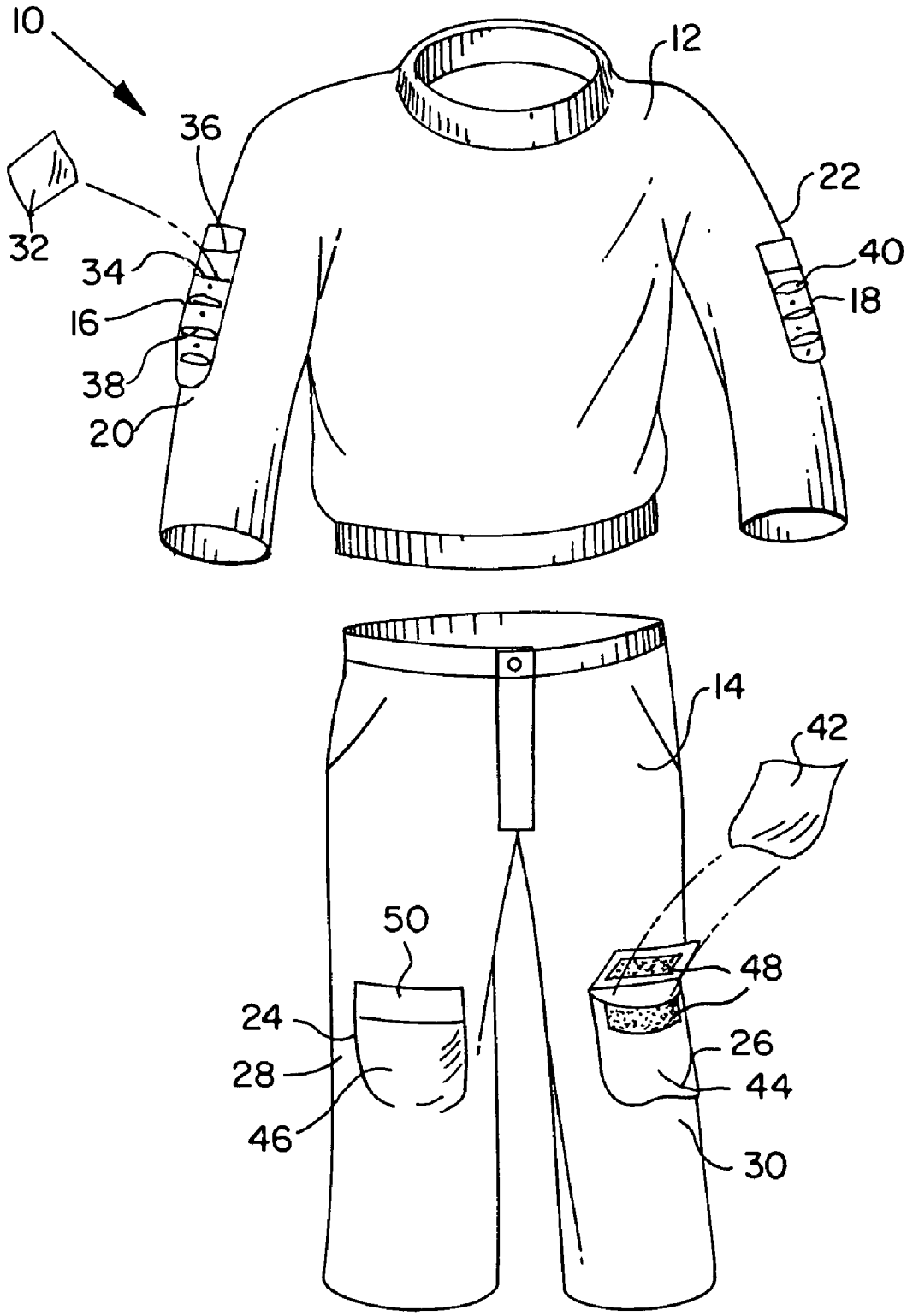
FIG. 1 illustrates an article of clothing according to one embodiment of the present invention.

Turning to the drawings, wherein like reference numerals refer to like elements, the present invention is illustrated as being implemented in an article of clothing. An article of clothing refers to any type of clothing, such as a shirt, pants, or one piece, can be used to implement the general idea of the present invention. In one embodiment of the present invention, a solution through the use of an article of clothing is provided to protect infants from injuries during crawling, while at the same time, assisting infants' learning process of crawling with the use of traction on the protective devices. Still another embodiment of the invention, these devices are easily removable for convenience of cleaning. Yet in another embodiment, these devices are incorporated into the clothing in a decorative manner to provide diminished visibility of these devices, creating, at the same time, an aesthetically pleasing garment. However, these various embodiments should not be taken as limiting the invention with regard to alternative embodiments that are not explicitly described herein.

Turning to FIG. 1, an article of clothing according to one embodiment of the present invention is shown and indicated generally at 10. The article of clothing is divided into two separate garments, specifically a shirt 12 and a pair of pants 14. The shirt 12 includes an elbow protective device 16, 18 that is incorporated into each elbow area 20, 22 of the clothing 10. The pants 14 also includes a knee protective device 24, 26 that is incorporated into each knee area 28, 30 of the clothing 10. Both the elbow 16, 18 and knee protective devices 24, 26 are removable in this embodiment.

Specifically, an elbow protective device 16 is shown to include a soft padding or insert 32 that is received at a pocket 34 attached to the elbow area. In this embodiment, the insert or soft padding 32 is preferably at least of a size that sufficiently covers the elbow area 20 for protection during crawling. Multiple embodiments of the insert are contemplated. Specifically, in one embodiment, the soft padding or insert is made with sufficient quantity of fabric materials to cover the area with a soft and flexible light padding for protection during crawling. With the fabric implementation, a soft cotton pad with the outer surface covered by decorative fabric may be used as an example. Another implementation contemplated is the use of a sealed soft liquid gel material that is at least of a size large enough to cover the elbow area for protection during crawling. The sealed liquid gel material is preferably soft, light, and flexible, and again, it can be similarly covered by decorative fabric. Moreover, a material of the insert 32 that can be easily inserted into the pocket 36 is preferred.

In order to properly secure the insert 32, the pocket 34 further includes a secure tab 36 for securing the insert 32 inside the pocket 34. The securing tab 36 secures the insert 32 through various implementations, such as buttons, zippers, or a hook and loop attachment means (such as Velcro®), which are readily appreciated by one skilled in the art. Thus, various implementations of the secure tab 36 is within the scope of the present invention. Because the insert 32 that protects the elbow can be easily removed from the shirt 12, the shirt along with the insert can be easily cleaned or washed. In case of a sealed soft gel material, it can be easily accessed for hand or manual wiping while the shirt can be washed through the use of washing machines.

Still in another embodiment, each of the elbow protective devices 16, 18 further preferably includes a traction device 38, 40 that is incorporated into the outer surface of the elbow area. The traction device 38, 40 includes sufficient coefficient of friction to create stable traction during crawling. In the embodiment, a rubberized material can be placed outside of the pocket as shown.

The knee protective device 24, 26 includes soft padding 42 similar to the one included with the elbow protective devices 16, 18. The soft padding 42, in this embodiment, is also implemented as a removable insert, which is received by a receiving pocket 44, 46 as shown. And each receiving pocket 44, 46 similarly include a secure tab 48, 50, respectively. The implementation of the knee protective device is preferably similar to that of the elbow protective device in order to match the shirt and the pants as one article of clothing. However, other implementations of these protective devices are contemplated and well appreciated by one skilled in the art, and these various implementations are within the scope of the present invention.

Figure 2:
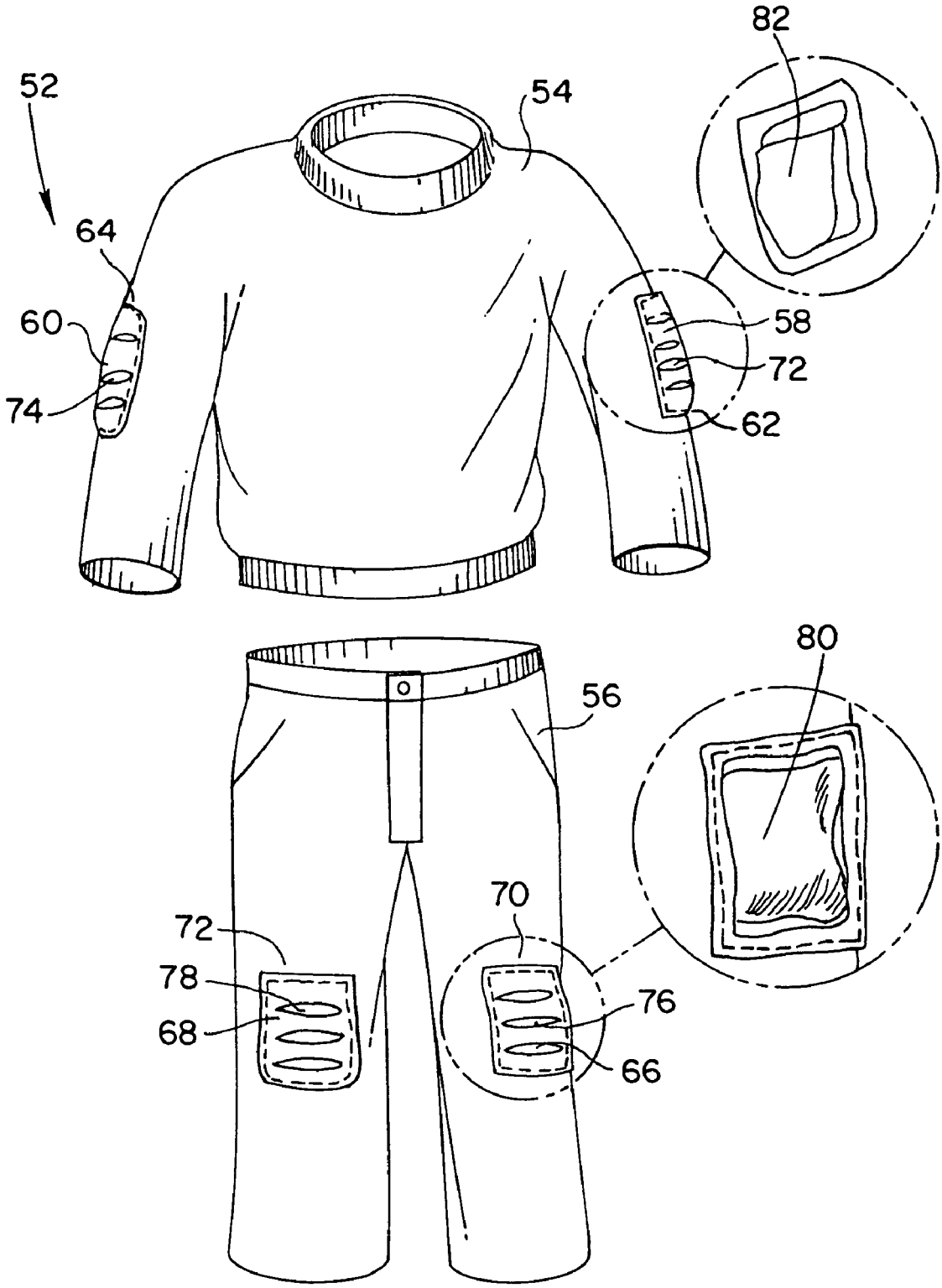
FIG. 2 illustrates an article of clothing according to another embodiment of the present invention.

Turning to FIG. 2, an article of clothing according to another embodiment of the present invention is shown and indicated generally at 52. In this embodiment, the article of clothing is again divided into a shirt 54 and a pair of pants 56. The shirt 54 includes an elbow protective device 58, 60 that is incorporated on each elbow area 62, 64, and the pants 56 include a knee protective device 66, 68 that is incorporated on each knee area 70, 72. The present embodiment further includes a traction device 72, 74 on the elbow protective devices 58, 60, and the knee protective device 66, 68 similarly includes traction devices 76, 78. The present embodiment is contemplated to be implemented in the similar manner as FIG. 1, except in this embodiment, the protective devices are permanently affixed to the article of clothing. In FIG. 2, a soft padding or insert 80 of the elbow protective device 58 and a soft padding or insert 82 of the knee protective device 66 is stitched on the top surface of the elbow and knee areas, respectively. These protective devices can also be stitched on the inside surface of the elbow and knee areas, which is readily appreciated by one skilled in the art, and it is within the scope of the present invention.

Figure 3:
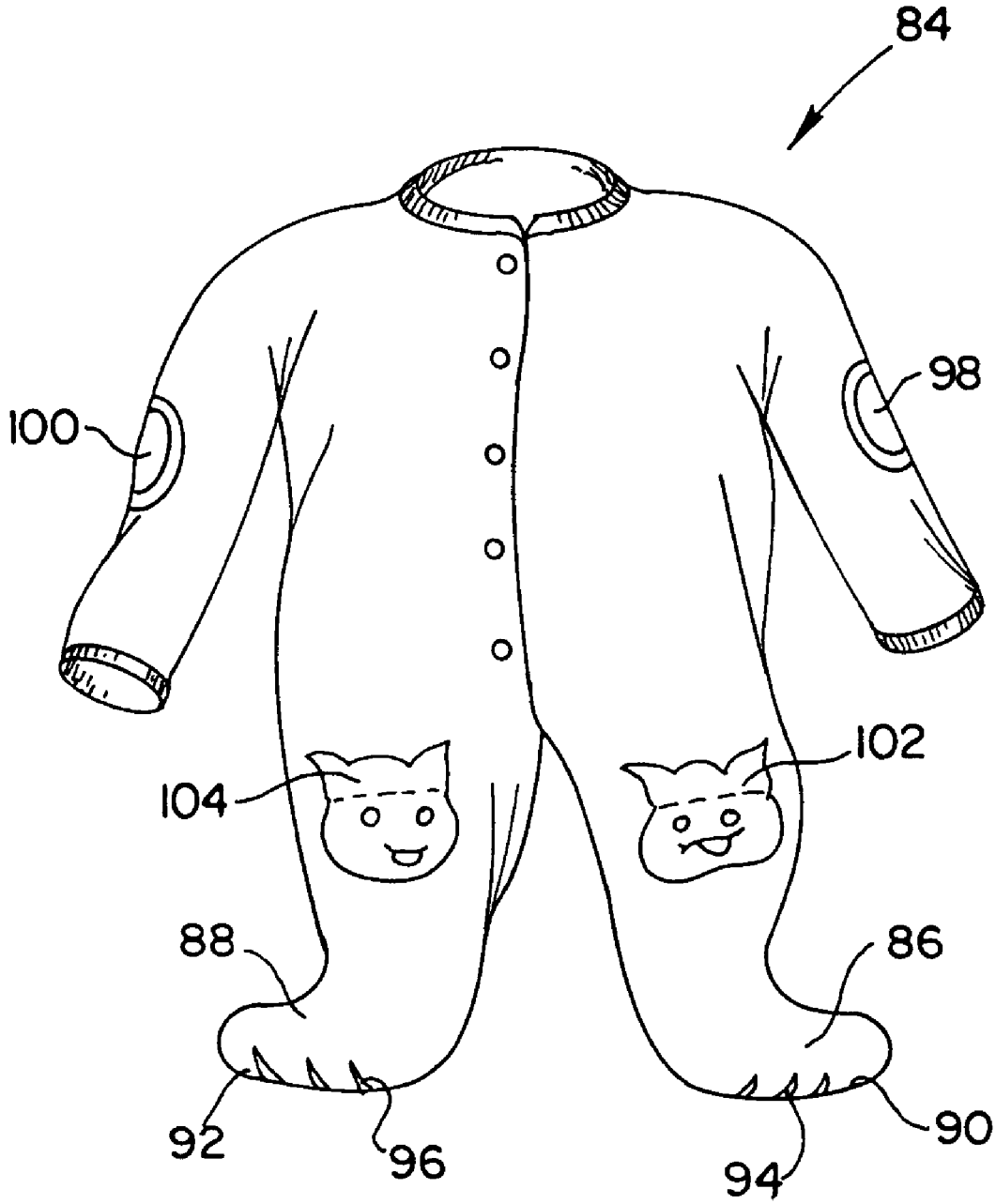
FIG. 3 illustrates an article of clothing according to still another embodiment of the present invention.

Turning now to FIG. 3, an article of clothing according to still another embodiment of the present invention is shown and indicated generally 84. The present embodiment is implemented in a similar manner as FIGS. 1 and 2, except that the present embodiment further includes a foot protective device 86, 88 incorporated into each foot area of the clothing 84. Each foot protective device 86, 88 includes a soft padding 90, 92 covering the foot area for protection during crawling. A traction device 94, 96 with a sufficient coefficient of friction is further included for each foot area to create stable traction during crawling. Moreover, in this embodiment, the article of clothing is a single piece that includes both the elbow and the knee areas. A decorative elbow 98, 100 and knee 102, 104 protective devices are shown as a cat picture. Other decorative implementations, such as a trademark, are contemplated, and these various decorative implementations are within the scope of the present invention.

In view of the many possible embodiments to which the principles of the present invention may be applied, it should be recognized that the embodiments described herein with respect to the drawing figures are meant to be illustrative only and should not be taken as limiting the scope of the invention. For example, those of skill in the art will recognize that the illustrated embodiments can be modified in arrangement and detail without departing from the spirit of the invention. Therefore, the invention as described herein contemplates all such embodiments as may come within the scope of the following claims and equivalents thereof.

I claim:

1. An article of infant clothing comprising:

at least one soft and flexible elbow protective device incorporated into each elbow area of the clothing, wherein the elbow protective device includes soft padding covering the elbow area for elbow protection;

at least one soft and flexible knee protective device incorporated into each knee area of the clothing, wherein the knee protective device includes soft padding covering the knee area for knee protection during crawling; and a traction device incorporated into at least one outer surface of the knee area or the elbow area, wherein the traction device includes sufficient coefficient of friction to create stable traction during crawling;

wherein at least one of the protective devices further comprises:

a removable insert of the soft padding, wherein the soft padding comprises a sufficient quantity of fabric materials to cover the area with a soft and flexible light padding for protection during crawling; and a receiving pocket adapted to receive the insert, wherein the pocket includes a secure tab for securing the insert inside the pocket.

2. The article of infant clothing according to claim 1, wherein the secure tab further comprises any one from the group of at least one button, a zipper, and a hook and loop attachment means, for securing the insert inside the pocket.

3. The article of infant clothing according to claim 1, wherein at least one of the protective devices is made of a predetermined decorative shape.

4. The article of infant clothing according to claim 1 further comprising at least one foot protective device incorporated into each foot area of the clothing, wherein the foot protective device includes soft padding covering the foot area for protection of the foot.

5. The article of infant clothing according to claim 1, wherein said traction device includes a plurality of ribs of rubberized material of sufficient coefficient of friction to create stable traction during crawling.

6. The article of infant clothing according to claim 1, wherein the fabric materials comprise a soft cotton pad.

7. An article of infant clothing comprising:

at least one soft and flexible knee protective device incorporated into each knee area of the clothing, wherein the knee protective device includes soft padding covering the knee area for protection during crawling;

a traction device incorporated into an outer surface of at least one knee area, wherein the traction device includes sufficient coefficient of friction to create stable traction during crawling;

wherein at least one of the protective devices further comprises:

a removable insert of the soft padding, wherein the soft padding comprises a sufficient quantity of fabric materials to cover the knee area with a soft and flexible light padding for protection during crawling; and a receiving pocket adapted to receive the insert, wherein the pocket includes a secure tab for securing the insert inside the pocket.

8. The article of infant clothing according to claim 7 further comprising at least one foot protective device incorporated into each foot area of the clothing, wherein the foot protective device includes soft padding covering the foot area for protection of the foot during crawling.

9. The article of infant clothing according to claim 7, wherein the secure tab further comprises any one from the group of at least one button, a zipper, and a hook and loop attachment means, for securing the insert inside the pocket.

10. The article of infant clothing according to claim 7, wherein at least one of the protective devices is made of a predetermined decorative shape.

11. The article of infant clothing according to claim 7, wherein said traction device includes a plurality of ribs of rubberized material of sufficient coefficient of friction to create stable traction during crawling.

12. The article of infant clothing according to claim 7, wherein the fabric materials comprise a soft cotton pad.

13. An article of infant clothing comprising:

at least one soft and flexible elbow protective device incorporated into each elbow area of the clothing, wherein the elbow protective device includes soft padding covering the elbow area for elbow protection during crawling; and a traction device incorporated into an outer surface of at least one elbow area, wherein the traction device includes sufficient coefficient of friction to create stable traction during crawling;

wherein at least one of the protective devices further comprises:

a removable insert of the soft padding, wherein the soft padding comprises a sufficient quantity of fabric materials to cover the area with a soft and flexible light padding for protection during crawling; and a receiving pocket adapted to receive the insert, wherein the pocket includes a secure tab for securing the insert inside the pocket.

14. The article of infant clothing according to claim 13, wherein the fabric materials comprise a soft cotton pad.

* * * * *